United States Patent [19]

Matsumoto

[11] 4,309,034

[45] Jan. 5, 1982

[54] COMPETITIVE GAME MOVING OBJECTS THROUGH ADJACENT DEPRESSIONS IN AN INCLINED SURFACE

[75] Inventor: Takao Matsumoto, Tokyo, Japan

[73] Assignee: Tomy Kogyo Co., Inc., Tokyo, Japan

[21] Appl. No.: 111,829

[22] Filed: Jan. 14, 1980

[30] Foreign Application Priority Data

Jan. 16, 1979 [JP] Japan ..... 54-3448[U]

[51] Int. Cl.[3] ..... A63F 9/14; A63B 67/12

[52] U.S. Cl. ..... 273/86 D; 273/357; 273/399

[58] Field of Search ..... 273/85 D, 85 E, 85 F, 273/119 R, 119 A, 357, 399

[56] References Cited

U.S. PATENT DOCUMENTS

| | | | |
|---|---|---|---|
| 469,948 | 3/1892 | Reed . | |
| 722,603 | 3/1903 | Morgan | 273/118 R |
| 1,611,728 | 12/1926 | Dreistadt . | |
| 2,864,620 | 12/1958 | Hooker et al. | 273/124 A |
| 3,129,941 | 4/1964 | Pearson . | |
| 3,395,920 | 8/1968 | Moe . | |
| 4,119,315 | 10/1978 | Goldfarb et al. | 273/119 R X |
| 4,149,725 | 4/1979 | Todokoro . | |

FOREIGN PATENT DOCUMENTS

| | | | |
|---|---|---|---|
| 680997 | 1/1930 | France | 273/119 R |
| 118992 | 7/1927 | Switzerland | 273/119 R |

*Primary Examiner*—Anton O. Oechsle

*Attorney, Agent, or Firm*—K. H. Boswell; Edward D. O'Brian

[57] ABSTRACT

A toy is described which has a housing which includes an elevated centralized object repository. Associated with the object repository is at least one peripheral section of the housing which includes an inclined top surface. The inclined top surface has a plurality of object locating holes which are arranged in sequence up the inclined surface. An object is sized to fit partly through the object locating holes. An object propulsion member fits beneath the top surface and includes a plurality of object striking projections which are located off-center beneath each of the object locating holes. When the object propulsion member is activated, if an object is located in one of the locating holes, the striking surface associated with that hole strikes the object and can propel the object toward the next locating hole. This is repeated until the object is deposited in the object repository.

11 Claims, 3 Drawing Figures

10
12
14
16
18
20
22
24
26
40
42
44
46
48
50
52
54
56
58
60
62-a
62-b
62-c
64
66-a
66-b
66-c
68
70
72
74
3
3

COMPETITIVE GAME MOVING OBJECTS THROUGH ADJACENT DEPRESSIONS IN AN INCLINED SURFACE

BACKGROUND OF THE INVENTION

A toy having a centralized elevated object repository has at least one inclined surface radiating upwardly toward the object repository. The inclined surface includes a plurality of holes sized to be smaller than the object and has a striking member located beneath it. When the striking member is forceably raised, projections on the surface of the striking member contact the object to propel the object toward the next hole in line with the repository.

Certain games are known wherein players compete with each other to step-wise move an object from one position to another in a contest to place their particular object in a centralized goal. A classic example of this type of game would be Tiddly Winks. Tiddly Winks can be played on either a hard or a comparatively soft surface. However, the young, inexperienced or otherwise physically inept player finds it difficult to master this simple game on a hard surface. This is because the disk that is to be moved must be flipped with a hand-held disk in a particular manner in order to move it.

Other games are known which utilize one principle of Tiddly Winks, that is, a contest between players to move their objects toward a central goal but which are based on using mechanical devices. Such games include a game described in U.S. Pat. No. 3,720,412 wherein two players can compete to move a spherical object through a series of buckets through one position to the next. Other games such as that described in U.S. Pat. No. 3,395,920 pits one player against the next in attempting to project a spherical object held in a bell crank type mechanism into the mouth of a rotating figure.

Games are also known where an object is either directly propelled toward a goal to achieve a score or where the object is used to move a mechanism which then moves a secondary object either toward a goal or in a race with another secondary object. Examples of these would be the toys or games described in U.S. Pat. No. 1,611,728 and U.S. Pat. No. 3,129,941.

While all of the above noted games which utilize mechanical apparatuses have certain play value, none of them really mimics the competitive spirit behind Tiddly Winks. It is considered that a game which utilizes a mechanical apparatus to incrementally move an object through a series of positions toward a centralized goal would be extremely interesting to younger children in that they could race against their peers to achieve the goal yet the apparatus would allow them to manipulate the object in a manner that their lack of physical coordination because of their tender age inhibits them from doing without the assistance of the apparatus.

SUMMARY OF THE INVENTION

It is an object of this invention to provide a toy which utilizes an apparatus which allows a player or players to move an object through a series of positions in hopes of finally placing the object in a goal. It is a further object to provide a toy that because of its simplicity of engineering is both economical to manufacture and both easy to use and resilient to excessive play.

These and other objects are achieved by providing a toy which comprises: a housing having an object repository located on the upper periphery of the housing; at least one peripheral section of said housing, said peripheral section having a top surface, said top surface including a plurality of object locating means arranged along the top surface of said peripheral section along a pathway leading toward said object repository; each of said object locating means including an opening in said top surface; an object propulsion means movably mounted in said peripheral section and including a plurality of object striking means equal in number to the number of said object locating means, said object propulsion means located in said peripheral section in a position locating each of said object striking means in association with said openings and displaced off-center of a line passing through the center of said opening; at least one object, the bottom portion of said object sized to fit into said opening to position the lowermost portion of said object in said opening such that when said object is located in any one of said object locating means and said object propulsion means is moved in said peripheral section the object striking means associated with the object locating means wherein said object is located is capable of striking said object at a point on the surface of said object which is displaced off-center from a line passing through the center of said object to propel said object out of said object locating means along a line passing through the center of said object and the object striking means striking said object; said object capable of moving along said pathway from one of said object locating means to the next adjacent object locating means and finally into said object repository means each time it is struck by one of said object striking means.

A plurality of peripheral sections can be provided which radiate from the elevated centralized object repository. Each of the peripheral sections would include its own series of object locating means as well as object propulsion means associated with it. A number of objects equal in number to the number of peripheral sections would be used.

While a single opening can be used it is preferable to provide the top surface with a series of depressions which have both a top opening and a bottom opening. At least a portion of each object fits through the top opening such that the lowermost portion of the object extends through the bottom opening. The object propulsion means is preferably a member movable in a horizontal manner and includes a plurality of projections on its surface which strike the object to propel the object.

BRIEF DESCRIPTION OF THE DRAWINGS

This invention will be better understood when taken in conjunction with the drawings wherein.

Figure 1:
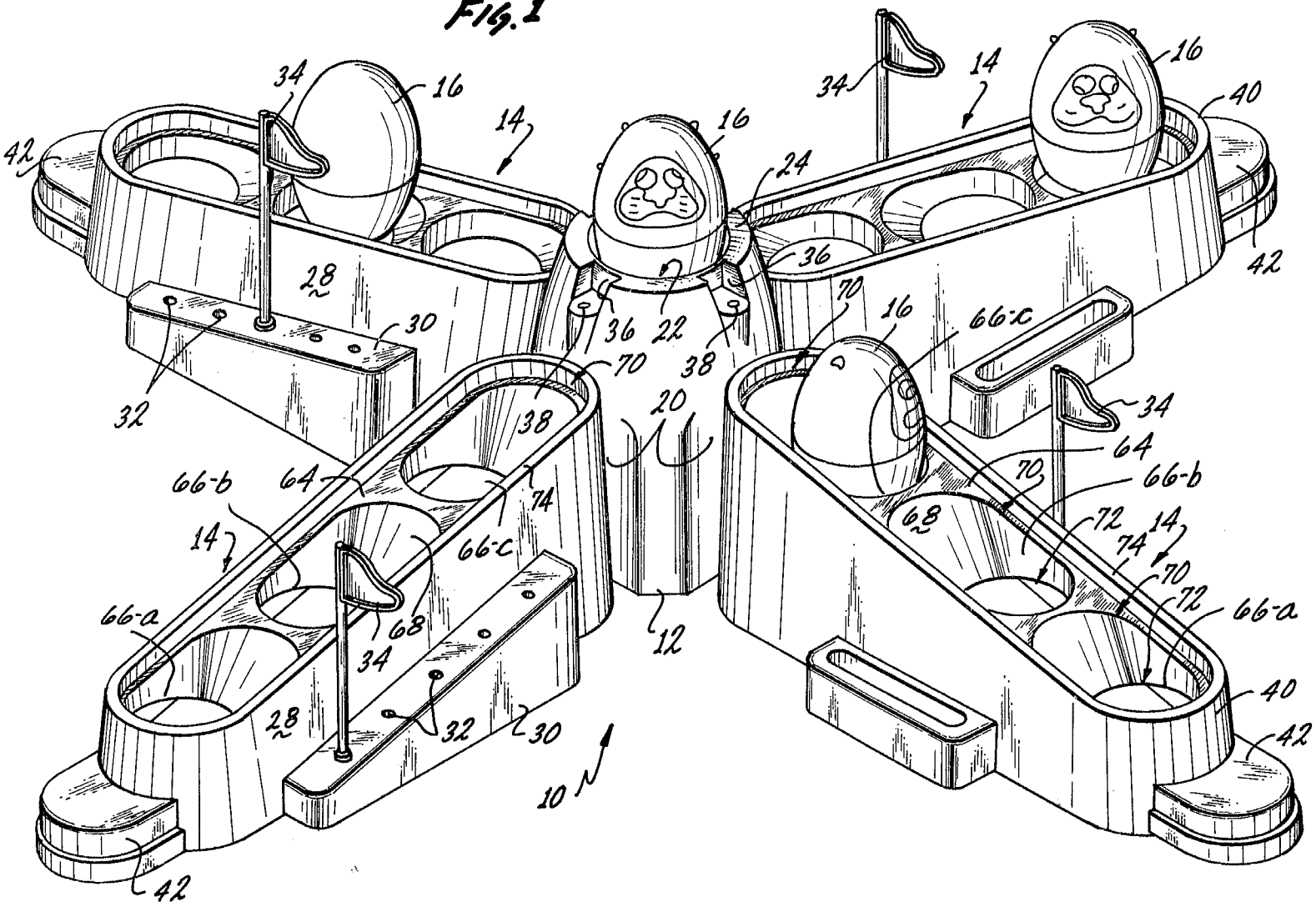
FIG. 1 is an isometric view of the toy of the invention.

The invention described in this specification and illustrated in the drawings utilizes certain principles or concepts which are set forth in the appended claims. Those skilled in the art to which this invention pertains will realize that these principles and/or concepts can be used with a number of differently appearing embodiments not identical to the embodiment herein described and illustrated. For this reason this invention is to be construed in light of the claims and is not to be construed as being limited to the embodiment illustrated and described.

DETAILED DESCRIPTION

The toy 10 of the invention has a complex housing having a centralized portion 12 and a plurality of identical peripheral sections all identified by the numeral 14. Because each of the peripheral sections 14 are identical only one need be described in detail. Additionally the toy 10 utilizes a plurality of identical objects 16 equal in number to the number of peripheral sections 14. In actual manufacture each of the objects 16 would be manufactured to be a different color thereby enabling each player to easily recognize his own object.

Figures 2, 3:
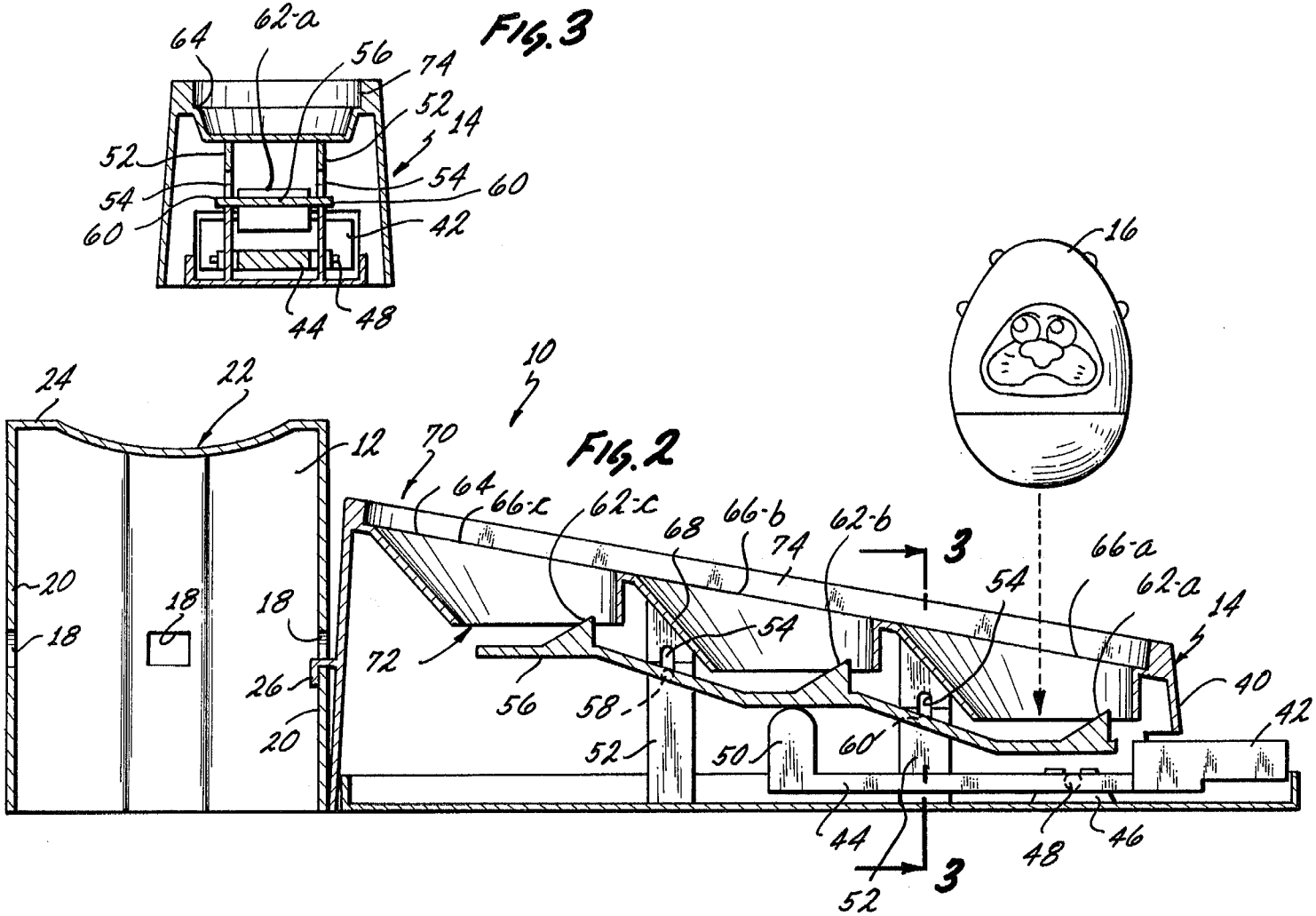
FIG. 2 is a side elevational view in section of any one of the identical spoke-like components shown in FIG. 1 as well as a portion of the centralized component.
FIG. 3 is an end elevational view in section about the line 3—3 of FIG. 2.

The centralized section 12 has a plurality of identical openings 18 one of which is shown in FIG. 2. The centralized section 12 is shown as having a square bottommost portion (not numbered). This allows four openings 18 to be centered on the essentially square faces 20 of the centralized section 12. Thus, four peripheral sections 14 can be used. It is understood, however, that the shape of the centralized section 12 could be modified to use either a lesser or greater number of peripheral sections 14. In the uppermost portion of the centralized section 12 there is an elevated object repository 22. This repository 22 is essentially a round depression located in the upper surface 24. It is sized to allow one of the objects 16 to rest in it.

Each of the peripheral sections 14 contain a small hook 26 which fits within one of the openings 18 on the centralized section 12. This allows each of the peripheral sections 14 to be fixedly attached to the centralized section 12 when the toy 10 is used but also allows for easy disassembly of the toy 10 for shipping and storage purposes. When the toy is to be used the peripheral sections 14 are attached to the centralized sectionn 12 by simply inserting the hooks 26 in the openings 18 and allowing the peripheral section 14 to rest on a support surface fixedly attaching the sections 14 to the section 12.

Along one side 28 of each of the peripheral sections 14 is a wedge 30 which has a series of holes 32 in its surface. Associated with each peripheral section 14 is a flag 34 which is sized to fit in and be retained in each of the holes 32. Located on the centralized section 12 associated with each peripheral section 14 is a depression 36 having a hole 38 therein which is also sized to receive and accept the flags 34. In manufacture the flags 34 would be color coded with the objects 16 to identify which flag belongs to which player.

Projecting out of end 40 of each of the peripheral sections 14 is a button 42. This button 42 is susceptible to being depressed as hereinafter explained which can cause movement of the object 16 as hereinafter explained.

Within each of the peripheral sections 14 is a lever 44. Button 42 is in fact integrally formed with lever 44 on one of its ends. The levers 44 are each pivotally mounted in bearing surfaces (not numbered or identified) which are located in two upstanding ears 46 (one of which is shown in FIG. 2). An axle 48 fits in the bearing surfaces thus allowing the lever 44 to pivot about axle 48 in response to movement of button 42. On the other end of lever 44 is an upstanding boss 50 having its upper end rounded.

Located within each of the peripheral sections 14 are four horizontally oriented posts collectively identified by the numeral 52, two of which are shown in the side view in FIG. 2 and one of these plus another one in the end view shown in FIG. 3. Each of the posts 52 contains an elongated slot 54. A propulsion member 56 winds within the interior of peripheral section 14 and is integrally formed with two axles 58 and 60 which are located in slots 54. The interaction of axles 58 and 60 in slots 54 allows the propulsion member 56 to move upwardly and downwardly within the interior of the peripheral section 14. Located on the upper surface of the propulsion member 56 are a series of identical wedge-shaped projections 62. Propulsion member 56 and thus its wedge shaped projection 62 are biased downwardly by gravity because of their weight. The propulsion member 56 comes to rest in a first or downward position governed by the interaction of axles 58 and 60 in slot 54. When button 42 is depresed movement of lever 44 moves boss 50 upwardly contacting it against the lower surface of propulsion member 56 causing propulsion member 56 to move upwardly in the slot 54. When the button 42 is released the weight of propulsion member 56 causes it to descend depressing both it and boss 50 downwardly and elevating button 42.

A top surface 64 in peripheral section 14 is inclined from end 40 of peripheral section 14 upwardly toward the object repository 22. Three identical depressions collectively identified by the numeral 66 are formed in top surface 64. These depressions 66 are formed by a continuous wall 68 which is vertically oriented toward end 40 but is obliquely slanted toward the centralized section 12. Thus the top opening 70 of each of the depressions 66 is of a larger diameter than the bottom opening 72.

The objects 16 are sized to fit through the top opening 70 into the depression 66 but not completely through the bottom opening 72. As viewed in the FIGS. the objects 16 are somewhat egg-shaped having a rounded bottom. When an object 16 is located within a depression 66 a portion of its rounded bottom surface will extend through the bottom opening 72. The wedge shaped projections 62 are located on the propulsion member 56 such that they are off-center with respect to the bottom openings 72. When an object 16 is located in one of the depressions 66 a portion of its bottom surface will come to rest against the wedge shaped projection 62. When the propulsion member 56 forcibly moves upwardly upon forcible depression of button 42 its motion is transferred via wedge shaped projection 62 to the object 16. However, the momentum imparted to the object 16 is off-center with respect to the vertical axis of the object 16 which causes the object 16 to be propelled in a direction away from the wedge shaped projection 62.

As is seen in FIG. 2 the combination of the orientation of the wedge shaped projection 62 and the shape of and location of the inclined portion of wall 68 allows an object 16 to be propelled from depression **66*a* toward depression 66*b* and from depression 66*b* toward depression 66*c* and finally from depression 66*c* toward the object repository 22. Further the shape of the inclined wall 68 assists in capturing the object 16 in the depression 66. Traversing around the top surface 64 of the peripheral sections 14 is a rib 74 which helps to maintain the object 16 on the peripheral section 14**.

In playing with the toy each of the players locates his particular object 16 in the lowermost depression **66*a***.

The players then forcibly depress the button 42 to strike the bottom of the object 16 with the projection 62. If sufficient force is imparted to the object 16 by the projection 62 the object 16 is lifted upward and forward from the depression 66*a* and lands in depression 66*b*.

The egg-shape of the object 16 tends to orient them in a manner shown in the figures, i.e., upright. When they land, however, in one of the depressions 66 they don't necessarily land in this perfect upright orientation. If their orientation is less than perfect the player controlling the particular object 16 must depress the button 42 with a lesser amount of force than that necessary to propel the object 16 out of the depression 66 to jiggle the object 16 within the depression 66 to correct its orientation. If the player should attempt to expel the object 16 from the depression 66 when it is not vertically oriented the object 16 will not be given momentum directing it to the next depression 66 but might lift it straight up in the air or cause it to fly off the side of the peripheral section 14. If the object 16 is projected totally off of the peripheral section 14 the player must begin over by depositing his object 16 in the lowermost depression 66*a*.

When the game is started a flag 34 is placed in the lowermost hole 32*a*. The player tries to successfully move his object 16 through the succession of depressions 66*a, b,* and *c* and then into the object repository 22. When he gets his object 16 in the object repository 22 he returns his object 16 to depression 66*a* and moves his flag to hole 32*b*. This is repeated until the flag 34 is stepwise moved through all of the holes 32 and is located in hole 32*e*. The next time the player moves his object 16 to the object repository 22 he places his flag in hole 38 adjacent to his peripheral section 14 and is thus the winner of the game.

The game is complicated by the fact that only one object 16 can be located in the object repository 22 at one time. If a player projects his object 16 toward the object repository 22 when another object 16 is located therein his object 16 will strike the object 16 already there and be ejected to the playing surface. If this happens he must place his object back into his depression 66*a* and start over again without moving his flag 34.

Once an object 16 is in the object repository 22 the player manually moves it back to his depression 66*a*. He can inject strategy into the game by having his object 16 remain there until such time as at least two other players have their objects in depression 66*c* waiting to locate their object 16 in the object repository 22. When he removes his object 16 from the repository 22 the other players must then compete to deposit their object 16 in the object repository 22. If two or more players are attempting to do this at the same time there is the likelihood that their two objects will bump into each other and neither one will be deposited to the repository 22 but both tumble to the playing surface requiring each of those players to start over again and not move his flag.

I claim:

1. A toy which comprises:

a housing having an elevated object repository located on the upper periphery of the housing;

at least one peripheral section of said housing, said peripheral section having a top surface, said toy surface including a plurality of object locating means arranged along the top surface of said peripheral section along a pathway leading towards said object repository, said top surface generally inclined towards said elevated object repository;

each of said object locating means including a first opening in said top surface and a wall displaced below said first opening, a portion of said wall distal from said object repository being vertically oriented and a portion of said wall proximal to said object repository being inclined from the vertical towards said object respository;

an object propulsion means movably mounted in said peripheral section and including a plurality of object striking means equal in number to the number of said object locating means, said object propulsion means located in said peripheral section in a position locating each of said object striking means in association with said openings and displaced off-center of a line passing through the center of said opening;

at least one object, the bottom portion of said object sized to fit into said opening to position the lowermost portion of said object in said opening such that when said object is located in any one of said object locating means and said object propulsion means is moved in said peripheral section the object striking means associated with the object locating means wherein said object is located is capable of striking said object at a point on the surface of said object which is displaced off-center from a line passing through the center of said object to propel said object out of said object locating means along a line passing through the center of said object and the object striking means striking said object;

said object capable of moving along said pathway from one of said object locating means to the next adjacent object locating means and finally into said object repository each time it is struck by one of said object striking means.

2. The toy of claim 1 including:

said object repository being centrally located on said housing;

a plurality of said peripheral sections, said plurality of sections arranged around said centralized elevated object repository such that the top surface of each of said plurality of peripheral sections is inclined toward said centralized elevated object repository;

a plurality of objects equal in number to the number of said peripheral sections.

3. The toy of claim 1 including:

said wall including a second opening, said second opening located at a lower position than said first opening;

said object propulsion means located in said peripheral section in a position so that each of said object striking means are located in association with one of said second openings and each of said object striking means is displaced off-center of a line passing through the center of said second opening wherein each of said object striking means is located;

said object is proportioned such that at least the bottom portion of said object is sized to fit through said first opening to position the lowermost portion of said object in association with said second openings such that the lowermost portion of said object is capable of being struck at a point on the lowermost surface of said object which is displaced off-center from a line passing through the center of said object to propel said object along a line passing through the center of said object and the object striking means striking said object.

4. The toy of claim 2 including:

each of said peripheral sections including an equal number of a plurality of object locating means arranged along the top surface of each of said peripheral sections along a pathway which is symmetrical with regard to the other of said peripheral sections.

5. The toy of claim 4 including:

said wall including a second opening, said second opening located at a lower position than said first opening;

said object propulsion means located in said peripheral section in a position so that each of said object striking means are located in association with one of said second openings and each of said object striking means is displaced off-center of a line passing through the center of said second opening wherein each of said object striking means is located;

said object is proportioned such that at least the bottom portion of said object is sized to fit through said first opening to position the lowermost portion of said object in association with said second openings such that the lowermost portion of said object is capable of being struck at a point on the lowermost surface of said object which is displaced off-center from a line passing through the center of said object to propel said object along a line passing through the center of said object and the object striking means striking said object.

6. A toy which comprises:

a housing having a centralized elevated object repository located on the upper periphery of the housing;

a plurality of peripheral sections of said housing, each of said peripheral sections having a top surface, each of said top surfaces being generally inclined towards said elevated object repository, each of said top surfaces including a plurality of object locating means arranged along the top surface of each of said peripheral sections along a pathway leading towards said object repository;

each of said object locating means including an opening in said top surfaces;

an object propulsion means movably mounted in each of said peripheral sections and including a plurality of object striking means equal in number to the number of said object locating means, each of said object propulsion means located in said peripheral sections in a position locating each of said object striking means in association with said openings and displaced off-center of a line passing through the center of said openings;

a plurality of objects equal in number to the number of said peripheral sections, the bottom portion of each of said objects sized to fit into said openings to position the lowermost portion of said object in said openings such that when said object is located in any one of said object locating means and said object propulsion means is moved in said peripheral section the object striking means associated with the object locating means wherein said object is located is capable of striking said object at a point on the surface of said object which is displaced off-center from a line passing through the center of said object to propel said object out of said object locating means along a line passing through the center of said object and the object striking means striking said object;

said object capable of moving along said pathway from one of said object locating means to the next adjacent object locating means and finally into said object repository each time it is struck by one of said object striking means;

each of said peripheral sections including an equal number of a plurality of object locating means arranged along the top surface of each of said peripheral sections along a pathway which is symmetrical with regard to the other of said peripheral sections;

each of said object locating means having a first opening in said top surface and a wall displaced below said first opening, said wall including a second opening, said second opening located at a lower position than said first opening;

said object propulsion means located in each of said peripheral sections in a position so that each of said object striking means are located in association with one of said second openings and each of said object striking means is displaced off-center of a line passing through the center of said second opening wherein each of said object striking means is located;

said object is proportioned such that at least the bottom portion of said object is sized to fit through said first opening to position the lowermost portion of said object in association with said second openings such that the lowermost portion of said object is capable of being struck at a point on the lowermost surface of said object which is displaced off-center from a line passing through the center of said object to propel said object along a line passing through the center of said object and the object striking means striking said object;

said object repository is sized to hold only one of said objects such that if one of said objects is located in said repository another of said objects cannot be located in said repository until the first object in said repository is removed.

7. The toy of claim 6 wherein:

said object propulsion means comprises a first member movably mounted in each of said peripheral sections along a vertical axis between a first position and a second position;

a second member located in association with said first member and capable of moving said first member between said first and said second positions;

each of said object striking means comprises a projection on the surface of said first member said projection including a surface which is displaced off-center from the center of said second opening which said projection is associated with in a direction away from the pathway leading to the next adjacent first opening toward which said object will be propelled when struck by said projection;

said projection engaging said object when said first member moves from said first position to said second position transmitting the momentum of said first member to said object.

8. The toy of claim 7 wherein:

said projection is wedge-shaped.

9. The toy of claim 8 wherein:

said second member is an elongated member pivotally mounted between its two ends to the peripheral section in which it is located and includes one end which is exposed outside of said peripheral section such that it can be operated on by a player of the toy and the other end of which is located beneath said first member such that when the end which can be operated on by the player of the toy is depressed the other end lifts said first member upwardly to engage one of said wedge shaped projections against an object if said object is located in one of said first openings.

10. A toy which comprises:

a centralized main housing having an object repository located on the upper periphery of the housing;

a plurality of peripheral sections extending essentially radially from said main housing, each of said peripheral sections having a top surface, said top surface each including a plurality of object locating means arranged along the top surface of each of said peripheral sections along a pathway leading towards said object repository;

each of said object locating means including a first opening in its respective top surface and a wall displaced below said first opening, a portion of said wall distal from said object repository being vertically oriented and a portion of said wall proximal to said object respository being inclined from the vertical towards said object repository;

an object propulsion means movably mounted in each of said peripheral sections and including a plurality of object striking means equal in number to the number of said object locating means located in each respective top surface, said object propulsion means located in said peripheral sections in positions locating each of said object striking means in association with one of said openings and displaced off-center of a line passing through the center of said opening;

a plurality of objects equal in number to said peripheral sections, the bottom portion of said objects sized to fit into said openings to position the lowermost portion of said object in said opening such that when said object is located in any one of said object locating means and said object propulsion means is moved in said peripheral section the object striking means associated with the object locating means wherein said object is located is capable of striking said object at a point on the surface of said object which is displaced off-center from a line passing through the center of said object to propel said object out of said object locating means along a line passing through the center of said object and the object striking means striking said object towards said object repository;

said objects capable of moving along said pathways from one of said object locating means to the next adjacent object locating means and finally into said object repository each time it is struck by one of said object striking means.

11. The toy of claim 10 wherein:

said object propulsion means comprises a first member movably mounted in each of said peripheral sections along a vertical axis between a first position and a second position;

a second member located in association with said first member and capable of moving said first member between said first and said second positions;

each of said object striking means comprises a wedge shaped projection on the surface of said first member, said projection including a surface which is displaced off-center from the center of said first opening which said projection is associated with in a direction away from the pathway leading to the next adjacent first opening toward which said object will be propelled when struck by said projection;

said projection engaging said object when said first member moves from said first position to said second position transmitting the momentum of said first member to said object;

said second member is an elongated member pivotally mounted between its two ends to the peripheral section in which it is located and includes one end which is exposed outside of said peripheral section such that it can be operated on by a player of the toy and the other end of which is located beneath said first member such that when the end which can be operated on by the player of the toy is depressed the other end lifts said first member upwardly to engage one of said wedge shaped projections against an object if said object is located in one of said first openings.

* * * * *